US011341929B2

(12) United States Patent
Shan

(10) Patent No.: US 11,341,929 B2
(45) Date of Patent: May 24, 2022

(54) DRIVING METHOD, DISPLAY PANEL AND DRIVING CIRCUIT

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 415 days.

(21) Appl. No.: 16/461,371

(22) PCT Filed: Feb. 20, 2019

(86) PCT No.: PCT/CN2019/075520
§ 371 (c)(1),
(2) Date: May 16, 2019

(87) PCT Pub. No.: WO2020/155219
PCT Pub. Date: Aug. 6, 2020

(65) Prior Publication Data

US 2021/0327389 A1 Oct. 21, 2021

(30) Foreign Application Priority Data

Jan. 30, 2019 (CN) ..... 201910089177.6

(51) Int. Cl.
*G09G 3/36* (2006.01)

(52) U.S. Cl.
CPC ... *G09G 3/3688* (2013.01); *G09G 2300/0847* (2013.01); *G09G 2320/0214* (2013.01); *G09G 2320/0247* (2013.01)

(58) Field of Classification Search
CPC ..... G09G 3/3688; G09G 2300/0847; G09G 2320/0214; G09G 2320/0247;
(Continued)

(56) References Cited

U.S. PATENT DOCUMENTS

2005/0243045 A1* 11/2005 Kim ..... G09G 3/3659 345/87
2006/0145978 A1* 7/2006 Takatori ..... G02F 1/13306 345/87
(Continued)

FOREIGN PATENT DOCUMENTS

CN 101364021 A 2/2009
CN 101893774 A 11/2010
(Continued)

OTHER PUBLICATIONS

International Search Report issued in corresponding International application No. PCT/CN2019/075520, dated Oct. 30, 2019(8 pages).
(Continued)

*Primary Examiner* — Kent W Chang
*Assistant Examiner* — Sujit Shah

(57) ABSTRACT

The present application discloses a driving method, a display panel and a driving circuit. The driving method includes a step of outputting a gate driving signal to a corresponding gate line. A signal period of a common level signal of a common line includes a first time and a second time, the first time corresponds to a first common level, and the second time corresponds to a second common level; a voltage value of the first common level is less than that of the second common level; for a common line corresponding to the $N^{th}$ gate line, a start moment of the first time is no later than an open moment of the corresponding $N^{th}$ gate line, and a start moment of the second time is no earlier than a close moment of the $(N+1)^{th}$ gate line.

17 Claims, 5 Drawing Sheets

(58) Field of Classification Search
CPC ..... G09G 3/3648; G09G 2320/0626; G09G 2340/16; G02F 1/1368
See application file for complete search history.

(56) References Cited

U.S. PATENT DOCUMENTS

| | | | | |
|---|---|---|---|---|
| 2008/0180370 | A1 | 7/2008 | Huang et al. | |
| 2013/0038808 | A1* | 2/2013 | Song | G02F 1/136286 349/43 |
| 2018/0284510 | A1* | 10/2018 | Um | G02F 1/136286 |
| 2019/0163315 | A1* | 5/2019 | Kim | G02F 1/136286 |

FOREIGN PATENT DOCUMENTS

| | | | |
|---|---|---|---|
| CN | 103092377 | A | 11/2016 |
| CN | 106681040 | A | 5/2017 |
| CN | 108257576 | A | 7/2018 |
| CN | 109116641 | A | 1/2019 |
| CN | 109188796 | A | 1/2019 |

OTHER PUBLICATIONS

First Office Action from China patent office in a counterpart Chinese patent Application 201910089177.6, dated Nov. 28, 2019 (27 pages).
Second Office Action from China patent office in a counterpart Chinese patent Application 201910089177.6, dated May 15, 2020 (27 pages).
Third Office Action from China patent office in a counterpart Chinese patent Application 201910089177.6, dated Aug. 20, 2020 (15 pages).
Written Opinion of the International Searching Authority for No. PCT/CN2019/075520.

* cited by examiner

DRIVING METHOD, DISPLAY PANEL AND DRIVING CIRCUIT

The present application claims priority to the Chinese Patent Application No. CN201910089177.6, filed with the Chinese Patent Office on Jan. 30, 2019, and entitled "DRIVING METHOD, DISPLAY PANEL AND DRIVING CIRCUIT", which is incorporated herein by reference in its entirety.

TECHNICAL FIELD

The present application relates to the technical field of display, and in particular, to a driving method, a display panel and a driving circuit.

BACKGROUND

The statements herein merely provide background information related to the present application and do not necessarily constitute the prior art.

With the development and advancement of technologies, flat panel displays have become mainstream products of displays due to their thin bodies, power-saving and low radiation, and thus have been widely used. The flat panel displays include Thin Film Transistor-Liquid Crystal Displays (TFT-LCDs), Organic Light-Emitting Diode (OLED) displays, etc. The TFT-LCDs control the rotation direction of liquid crystal molecules to refract light of a backlight module to generate a picture, and has many advantages such as thin bodies, power-saving and no radiation. Moreover, the OLED displays are prepared by OLEDs, and have many advantages such as self-illumination, short response time, high definition and contrast, and can realize flexible display and large-area full-color display.

In the use of a general liquid crystal display, changes of the pixel voltage generally cause flickers, affecting the display effect.

SUMMARY

The present application provides a driving method, a display panel and a driving circuit for reducing flickers caused by a kickback voltage.

To achieve the foregoing objective, the present application provides a driving method, applied to a display panel. The display panel includes: a plurality of data lines and a plurality of gate lines, the gate lines being intersected with the data lines, further includes a plurality of pixels, each respectively driven by corresponding data line and gate line, each pixel including a corresponding pixel electrode; and a plurality of common lines respectively disposed between upper and lower gate lines, the common lines overlapping with a pixel electrode of a pixel corresponding to the previous gate line and overlapping with a pixel electrode of a pixel corresponding to the next gate line; the driving method includes a step of outputting a gate driving signal to a corresponding gate line of the display panel; where a signal period of a common level signal of the common line includes a first time and a second time, the first time corresponds to a first common level, the second time corresponds to a second common level, and a voltage value of the first common level in the first time is less than a voltage value of the second common level in the second time; for the common line corresponding to the $N^{th}$ gate line, a start moment of the first time is no later than an open moment of the corresponding $N^{th}$ gate line, and a start moment of the second time is no earlier than a close moment of the $(N+1)^{th}$ gate line; and N is a natural number at least equal to 1.

Optionally, at a same moment, the common line corresponding to the $N^{th}$ gate line is open at the first time, and the corresponding $N^{th}$ gate line is also open.

Optionally, the start moment of the second time and the close moment of the $(N+1)^{th}$ gate line are the same moment.

Optionally, the each pixel includes a pixel electrode, a same common line is connected to two adjacent pixels to form a pixel group, the pixel group includes a first pixel and a second pixel, and the first pixel and the second pixel are connected to different data lines and gate lines; where a pixel electrode of the first pixel of the pixel group overlaps with the common line to form a first overlap region; a first storage capacitance formed by the first overlap region of the first pixel and the common line is Cst1, a pixel capacitance of the first pixel is Clc1, and a parasitic capacitance formed by the pixel electrode of the first pixel and the $N^{th}$ gate line is Cgs1; the first common level corresponding to the first time is Vcom, and the second common level corresponding to the second time is V'com; a voltage value of a high level of the gate open time is VGH, and a voltage value of a low level of the gate close time is VGL; Cst1=(VGH−VGL)*Cgs1 (V'com−Vcom).

Optionally, a pixel electrode of the second pixel of the pixel group overlaps with a same common line corresponding to the first pixel to form a second overlap region, a second storage capacitance formed by the second overlap region of the second pixel and the common line is Cst2, a pixel capacitance of the second pixel is Clc2, and a parasitic capacitance formed by the pixel electrode of the second pixel and the $(N+1)^{th}$ gate line is Cgs2; Cst2=(VGH−VGL) *Cgs2/(V'com−Vcom).

The present application discloses a display panel using the driving method, including: a plurality of pixels, a plurality of data lines and a plurality of gate lines, the gate lines being intersected with the data lines, each pixel being separately driven by corresponding data line and gate line, and the each pixel corresponding to a pixel electrode; and a plurality of common lines disposed between upper and lower gate lines; where a same common line is connected to two adjacent pixels to form a pixel group, the pixel group includes a first pixel and a second pixel, and the first pixel and the second pixel are connected to different data lines and gate lines; where pixel electrodes of the first pixel and the second pixel overlap with the same common line to form a first overlap region and a second overlap region, respectively.

Optionally, the common lines include main common lines and auxiliary common lines conducted to each other; the main common lines are intersected with the data lines, and the auxiliary common lines and the data lines are arranged in parallel; the main common lines overlap with the pixel electrode of the first pixel and the pixel electrode of the second pixel to form a first main overlap region and a second main overlap region, respectively; the auxiliary common lines include first auxiliary common lines and second auxiliary common lines, the pixel electrode of the first pixel and the first auxiliary common lines form a first auxiliary overlap region, and the pixel electrode of the second pixel and the second auxiliary common lines form a second auxiliary overlap region.

Optionally, there are two first auxiliary common lines, respectively disposed at both sides of the first pixel close to the data lines; and the two first auxiliary common lines overlap with the pixel electrode of the first pixel to form two overlap regions; there are two second auxiliary common lines, respectively disposed at both sides of the second pixel close to the data lines; and the two second auxiliary common lines overlap with the pixel electrode of the second pixel to form two overlap regions.

Optionally, the first auxiliary common line and the second auxiliary common line are a straight line.

Optionally, the two second auxiliary common lines and the two first auxiliary common lines form two straight lines.

Optionally, a first safety distance is arranged between the first auxiliary common line and the pixel electrode of the first pixel.

Optionally, a second safety distance is arranged between the auxiliary common line and the corresponding data line.

The present application discloses a driving method configured to driving a display panel. The display panel includes: a plurality of data lines and a plurality of gate lines intersected with each other, and further includes a plurality of pixels, each respectively driven by corresponding data line and gate line, each pixel including a corresponding pixel electrode; and a plurality of common lines respectively disposed between upper and lower gate lines, where a same common line is connected to two adjacent pixels to form a pixel group, the pixel group includes a first pixel and a second pixel, and the first pixel and the second pixel are connected to different data lines and gate lines, where the common line overlaps with a pixel electrode of a first pixel corresponding to the previous gate line to form a first overlap region, and the common line overlaps with a pixel electrode of a second pixel corresponding to the next gate line to form a second overlap region. The driving circuit includes a gate driving circuit configured to output a gate driving signal to a corresponding gate line of the display panel; where a signal period of a common level signal of the common line includes a first time and a second time, the first time corresponds to a first common level, the second time corresponds to a second common level, and a voltage value of the first common level in the first time is less than a voltage value of the second common level in the second time; for the common line corresponding to the $N^{th}$ gate line, a start moment of the first time is no later than an open moment of the corresponding $N^{th}$ gate line, and a start moment of the second time is later than a close moment of the $(N+1)^{th}$ gate line, and N is a natural number at least equal to 1.

Optionally, the common line corresponding to the $N^{th}$ gate line is open at the first time, and the $N^{th}$ gate line is also open.

Optionally, the start moment of the second time and the close moment of the $(N+1)^{th}$ gate line are the same moment.

Optionally, the each pixel includes a pixel electrode, a same common line is connected to two adjacent pixels to form a pixel group, the pixel group includes a first pixel and a second pixel, and the first pixel and the second pixel are connected to different data lines and gate lines; where a pixel electrode of the first pixel of the pixel group overlaps with the common line to form a first overlap region; a first storage capacitance formed by the first overlap region of the first pixel and the common line is Cst1, a pixel capacitance of the first pixel is Clc1, and a parasitic capacitance formed by the pixel electrode of the first pixel and the $N^{th}$ gate line is Cgs1; the first common level corresponding to the first time is Vcom, and the second common level corresponding to the second time is V'com; a voltage value of a high level of the gate open time is VGH, and a voltage value of a low level of the gate close time is VGL; Cst1=(VGH−VGL)*Cgs1/(V'com−Vcom).

Optionally, a period of the first time is triple a period of the open time of a gate line.

Optionally, a pixel electrode of the second pixel of the pixel group overlaps with a same common line corresponding to the first pixel to form a second overlap region, a second storage capacitance formed by the second overlap region of the second pixel and the common line is Cst2, a pixel capacitance of the second pixel is Clc2, and a parasitic capacitance formed by the pixel electrode of the second pixel and the $(N+1)^{th}$ gate line is Cgs2; Cst2=(VGH−VGL)*Cgs2/(V'com−Vcom).

Compared to the solution of further dividing RGB sub-pixels into main/sub-pixels so that the overall large view-angle brightness is closer to the front view with the voltage change, i.e., applying different driving voltages by the main/sub-pixels spatially to solve the color offset of the view angle, in the present application, the gate electrode and the pixel electrode generate a parasitic capacitance Cgs, and a kickback voltage generated by the parasitic capacitance Cgs redistributes a storage capacitance and a liquid crystal capacitance, two pixels corresponding to the upper and lower gate lines of the same common line are respectively formed with a storage capacitance Cst; when the corresponding n gate lines are closed, the charging voltage of the pixel electrode may have a drop due to the influence of the parasitic capacitance. In this solution, two different common levels are provided, and the voltage value of the first common level in the first time is less than the voltage value of the second common level in the second time; the common line increases from a lower first common level to a higher second common level after the close moment of the $(N+1)^{th}$ gate line, and thus has a rising edge, which would affect the charging voltage of the corresponding pixel and can cancel at least a part of the drop. Increasing the storage capacitance as far as possible can reduce the flickers formed by the kickback voltage, increase the voltage maintenance rate and reduce the voltage drop of the pixel electrode, without sacrificing a light-transmission opening region, influencing the penetration rate of the panel, or increasing the backlight cost.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
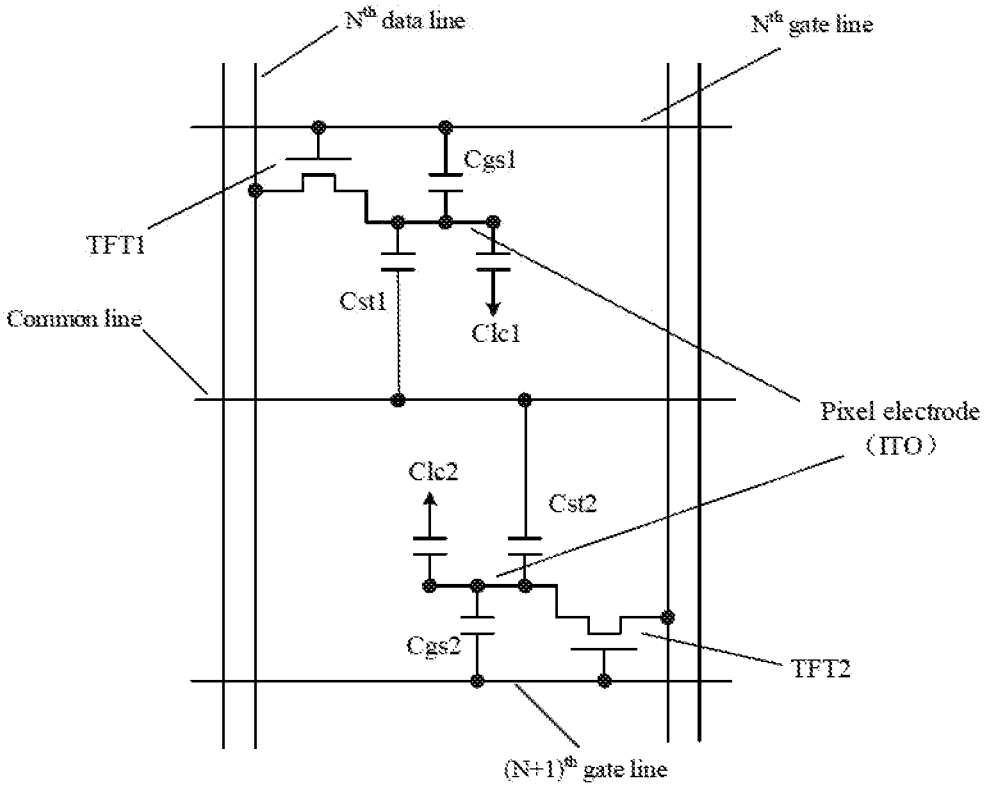
FIG. 1 is a schematic diagram of a pixel structure according to an embodiment of the present application.

It should be understood that the terms used herein and the specific structure and function details disclosed herein are merely representative, and are intended to describe specific embodiments. However, the present application can be specifically embodied in many alternative forms, and should not be interpreted to be limited to the embodiments described herein.

In the description of the present application, the terms such as "first" and "second" are merely for a descriptive purpose, and cannot be understood as indicating a relative importance, or implicitly indicating the number of the indicated technical features. Hence, the features defined by "first" and "second" can explicitly or implicitly include one or more features, and "a plurality of" means two or more, unless otherwise stated. The term "include" and any variations thereof are intended to cover a non-exclusive inclusion, and the presence or addition of one or more other features, integers, steps, operations, elements, components and/or combinations thereof may be possible.

In addition, orientation or position relationships indicated by the terms "center", "transversal", "upper", "lower", "left", "right", "vertical", "horizontal", "top", "bottom", "inner", "outer", etc. are based on the orientation or relative position relationships as shown in the drawings, for ease of the description of the present application and simplifying the description only, rather than indicating that the indicated device or element must have a particular orientation or be constructed and operated in a particular orientation. Therefore, these terms should not be understood as a limitation to the present application.

In addition, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by a person of ordinary skill in the art according to specific circumstances.

The present application is further described below with reference to the accompanying drawings and optional embodiments.

Figure 2:
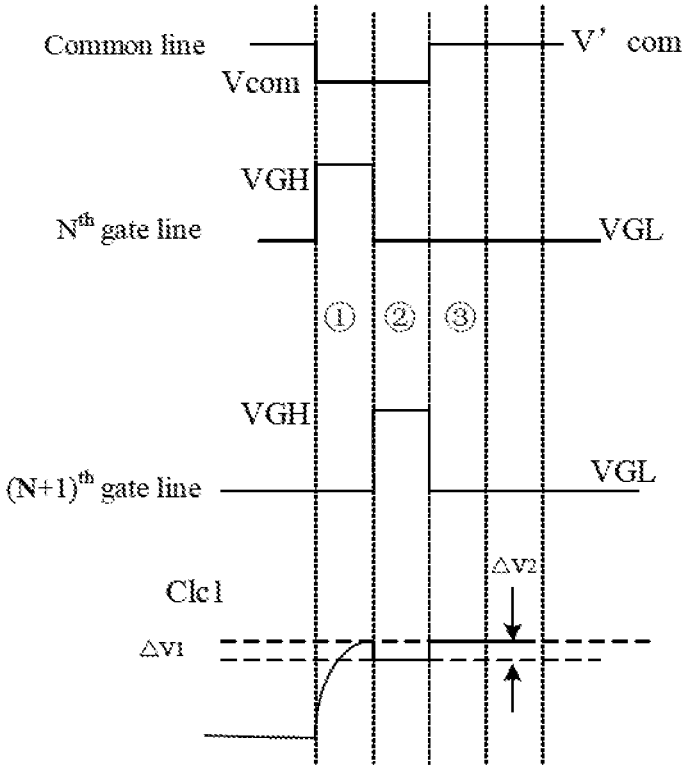
FIG. 2 is a schematic diagram of a driving waveform according to an embodiment of the present application.
Figure 6:
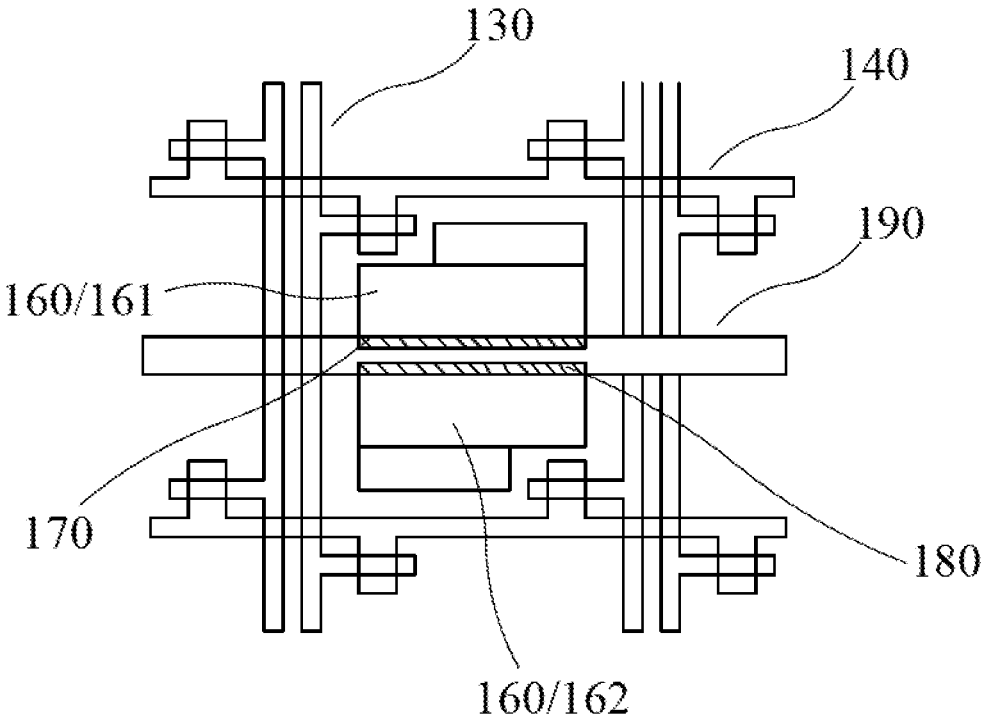
FIG. 6 is a schematic diagram of a pixel structure according to another embodiment of the present application.
Figure 7:
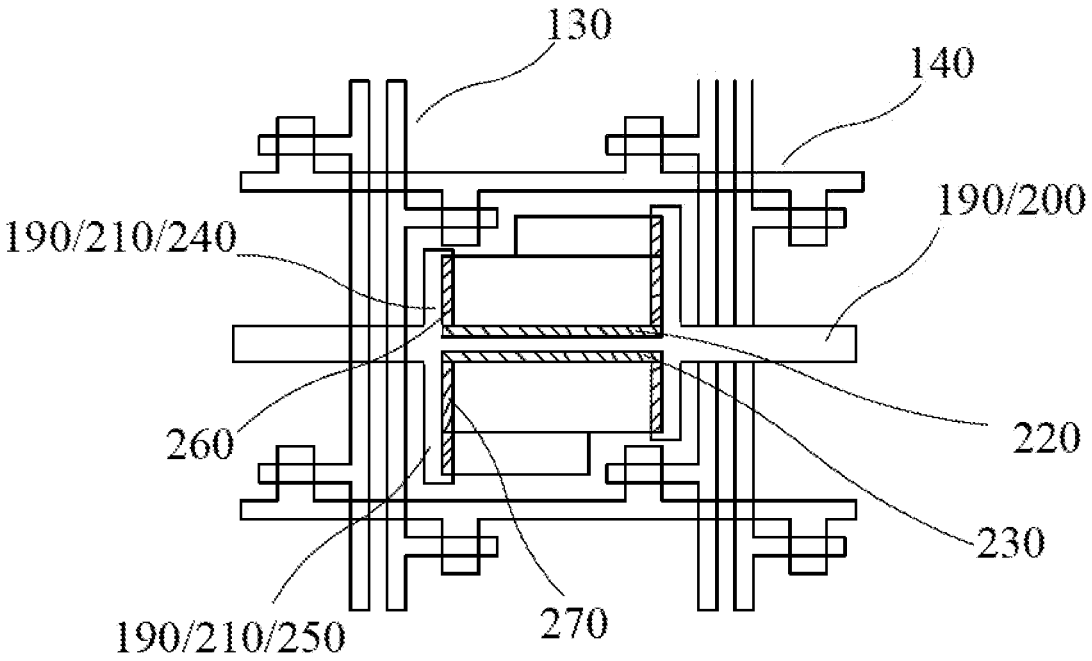
FIG. 7 is a schematic diagram of a pixel structure having auxiliary common lines according to another embodiment of the present application.
Figure 8:
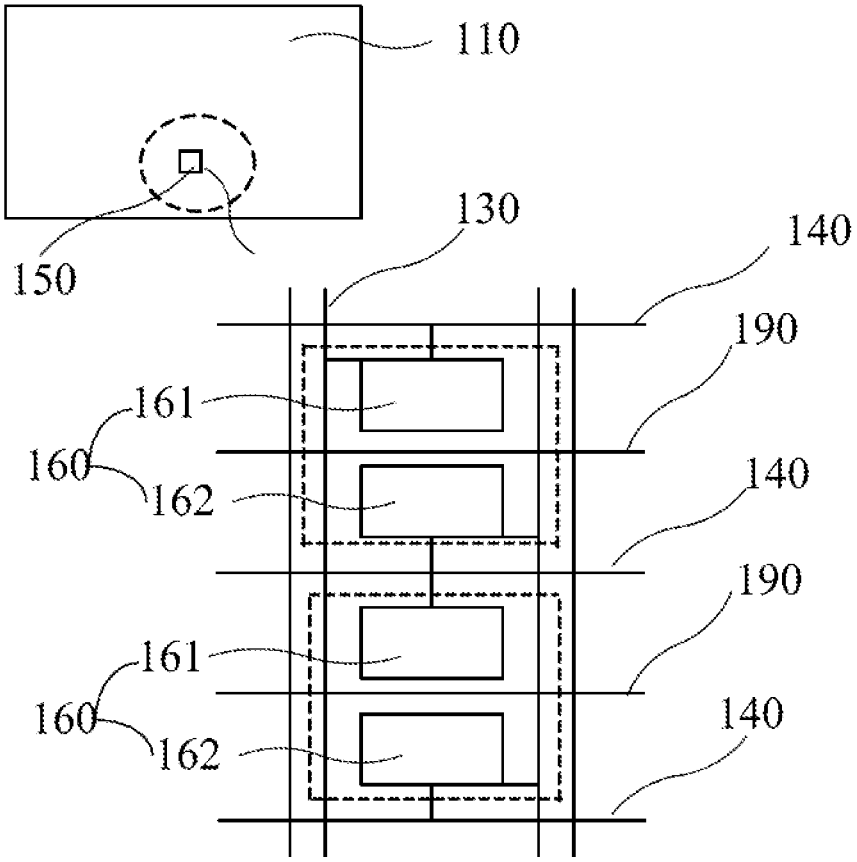
FIG. 8 is a schematic diagram of a display panel according to another embodiment of the present application.

As shown in FIGS. 1-8, an embodiment of the present application discloses a driving method applied to a display panel 110. As shown in FIG. 8, the display panel 110 includes a plurality of pixels 150 formed by intersecting a plurality of data lines 130 with a plurality of gate lines 140, and a plurality of common lines 190. Each common line 190 is separately disclosed upper and lower gate lines 140; the common line 190 overlaps with a pixel electrode of a pixel corresponding to the previous gate line, and overlaps with a pixel electrode of a pixel corresponding to the next gate line. The driving method includes a step of outputting a gate driving signal to a corresponding gate line 140 of the display panel 110. As shown in FIG. 2, a signal period of a common level signal of the common line 190 includes a first time and a second time; the first time corresponds to a first common level, and the second time corresponds to a second common level; a voltage value of the first common level in the first time is less than a voltage value of the second common level in the second time; for the common line 190 corresponding to the $N^{th}$ gate line 140, a start moment of the first time is no later than an open moment of the corresponding $N^{th}$ gate line 140, and a start moment of the second time is no earlier than a close moment of the $(N+1)^{th}$ gate line 140.

In this solution, a common voltage on a color filter substrate can be a level signal of any common line 190, i.e., can be the first common level, and can also be the second common level; the gate electrode and the pixel 150 electrode generate a parasitic capacitance Cgs, and a kickback voltage generated by the parasitic capacitance Cgs redistributes a storage capacitance and a liquid crystal capacitance, two pixels 150 corresponding to the upper and lower gate lines 140 of the same common line 190 are respectively formed with a storage capacitance Cst; when the corresponding n gate lines 140 are closed, the charging voltage of the pixel 150 electrode may have a drop (ΔV) due to the influence of the parasitic capacitance. In this solution, two different common levels are provided, and the voltage value of the first common level in the first time is less than the voltage value of the second common level in the second time; the common line 190 increases from a lower first common level to a higher second common level after the close moment of the $(N+1)^{th}$ gate line 140, and thus has a rising edge, which would affect the charging voltage of the corresponding pixel 150 and can cancel at least a part of the drop (ΔV). Increasing the storage capacitance as far as possible can reduce the flickers formed by the kickback voltage, increase the voltage maintenance rate and reduce the voltage drop of the pixel 150 electrode.

In one or more embodiments, as shown in FIG. 2, at a same moment, the common line 190 corresponding to the $N^{th}$ gate line 140 is open, and the $N^{th}$ gate line 140 is also open. In this solution, the $N^{th}$ gate line 140 is open while the common line 190 corresponding to the $N^{th}$ gate line 140 is open; the parasitic capacitance will redistribute the kickback voltage when the gate line 140 is open, the charging voltage of the pixel 150 electrode will have a drop (ΔV), and the common line 190 has an effect of shielding the electric field; the electrical field is formed between the pixel 150 electrode and the common line 190. Opening the common line 190 reduces the formation of the electric field between the pixel 150 electrode and the data line 130, and additionally increases the storage capacitance to cancel part of the drop (ΔV); if the corresponding $N^{th}$ common line 190 is not open when the $N^{th}$ gate line 140 is open, the drop (ΔV) cannot be canceled, and thus correspondence cannot be achieved, to cause confusion, causing abnormal display of the display panel 1101 that is, simultaneous opening can mainly cancel the influence of a part of the signal fluctuation on the pixel 150 electrode, so that the driving voltage tends to be more stable and the display effect is more guaranteed.

In one or more embodiments, the start moment of the second time and the close moment of the (N+1)th gate line 140 are the same moment. In this solution, the close moment of the (N+1)th gate line 140 is also the start moment of the second time; the common line 190 increases from a lower first common level to a higher second common level from the first time to the second time, and thus has a rising edge, which would affect the charging voltage of the corresponding pixel 150 and can cancel at least a part of the drop (ΔV), and simultaneous opening can mainly cancel the influence of a part of the signal fluctuation on the pixel 150 electrode, so that the driving voltage tends to be more stable.

In one or more embodiments, each pixel 150 includes a pixel 150 electrode, a same common line 190 is connected to two adjacent pixels 150 to form a pixel group 160, the pixel group 160 includes a first pixel 161 and a second pixel 162 connected to different data lines 130, where a pixel 150 electrode of the first pixel 161 of the pixel group 160 overlaps with the common line 190 to form a first overlap region 170; a first storage capacitance formed by the first overlap region 170 of the first pixel 161 and the common line 190 is Cst1, a pixel capacitance of the first pixel 161 is Clc1, a parasitic capacitance formed by the pixel 150 electrode of the first pixel 161 and the current gate line is Cgs1, the first common level corresponding to, the first time is Vcom, and the second common level corresponding to the second time is V'com, voltage value of a high level of the gate open time is VGH, and a voltage value of a low level of the gate close time is VGL; Cst1=(VGH−VGL)*Cgs1/(V'com−Vcom). In this solution, the change of the gate voltage redistributes the liquid crystal capacitance and the storage capacitance charge of the pixels through the parasitic capacitance Cgs, so that a kickback phenomenon occurs to the voltage of the charged pixel 150 electrode, as shown in FIG. 2:

At ①, Vpixel=Vdata.

At ②ΔV1=(VGH−VGL)*Cgs1/(Cgs+Cst+Clc).

At ③, ΔV2=(Vcom−V'com)*Cst1/(Cgs+Cst+Clc).

In order to reduce flicker issue caused by kickback, it is designed that ΔV1+ΔV2=0, and Cst1=(VGH−VGL)*Cgs1/(V'com−Vcom).

In one or more embodiments, a pixel 150 electrode of the second pixel 162 of the pixel group 160 overlaps with a same common line 190 corresponding to the first pixel 161 to form a second overlap region 180, a second storage capacitance formed by the second overlap region 180 of the second pixel 162 and the common line 190 is Cst2, a pixel capacitance of the second pixel is Clc2, and a parasitic capacitance formed by the pixel 150 electrode of the second pixel 162 and the next gate line 140 is Cgs2; Cst2=(VGH−VGL)*Cgs2/(V'com−Vcom).

Figure 3:
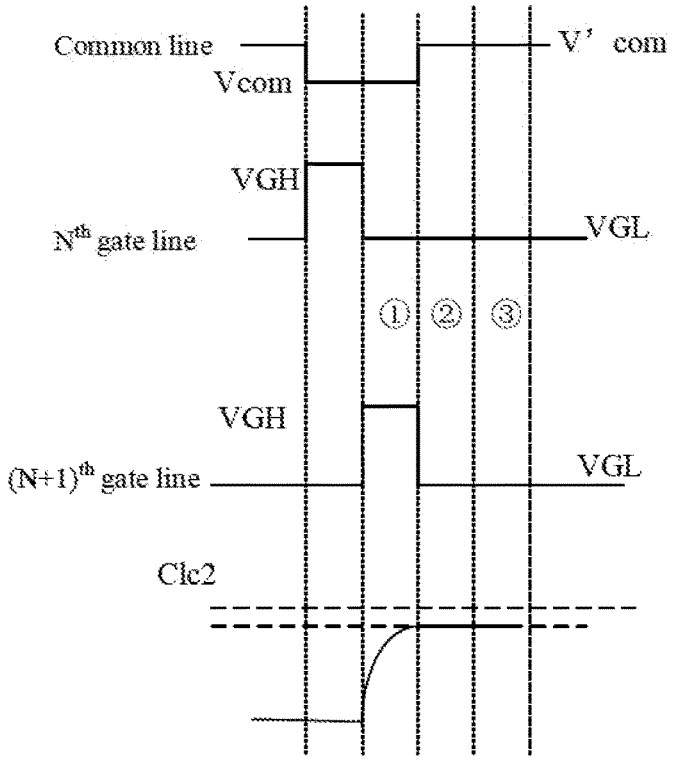
FIG. 3 is a schematic diagram of a driving waveform according to an embodiment of the present application.

In this solution, as shown in FIG. 3.

At ①, Vpixel=Vdata.

At ②, ΔV1=ΔV'1+ΔV"1.

$$\Delta V'1=(VGH-VGL)*Cgs2/(Cgs+Cst+Clc).$$

$$\Delta V''1=(V'\text{com}-V\text{com})*CSt2/(Cgs+Cst+Clc)$$

In order to reduce the flicker issue caused by kickback, it is designed that ΔV1=0, and Cst2=(VGH−VGL)*Cgs2/(V'com−Vcom).

In one or more embodiments, a period of the first time is triple a period of the open time of a gate line 140. In this solution, when the corresponding n gate lines 140 are closed, the charging voltage of the pixel 150 electrode may have a drop (ΔV) due to the influence of the parasitic capacitance; the open period of the first time is triple the period of the open time of a gate line 140, and is approximate to or even completely cancel ΔV so that the driving voltage of the pixel 150 tends to be more stable.

Figure 4:
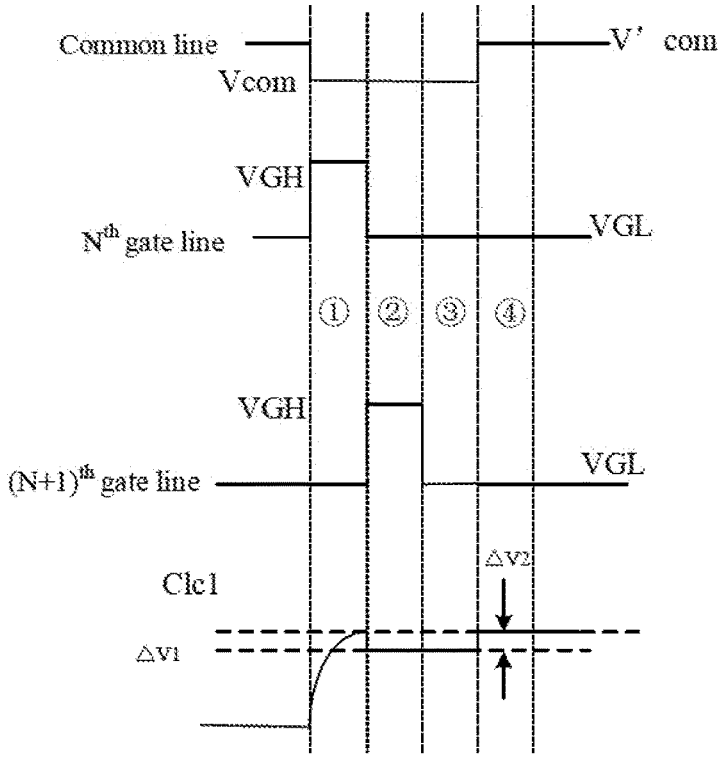
FIG. 4 is a schematic diagram of a driving waveform according to another embodiment of the present application.

As shown in FIG. 4.

At ①, Vpixel=Vdata

At ②, ΔV1=(VGH−VGL)*Cgs1/(Cgs+Cst+Clc).

At ④, ΔV2=(Vcom−V'com)*Cst1/(Cgs+Cst+Clc).

In order, to reduce flicker issue caused by kickback, it is designed that ΔV1+ΔV2=0, and Cst1=(VGH−VGL)*Cgs1/V'com−Vcom).

Figure 5:
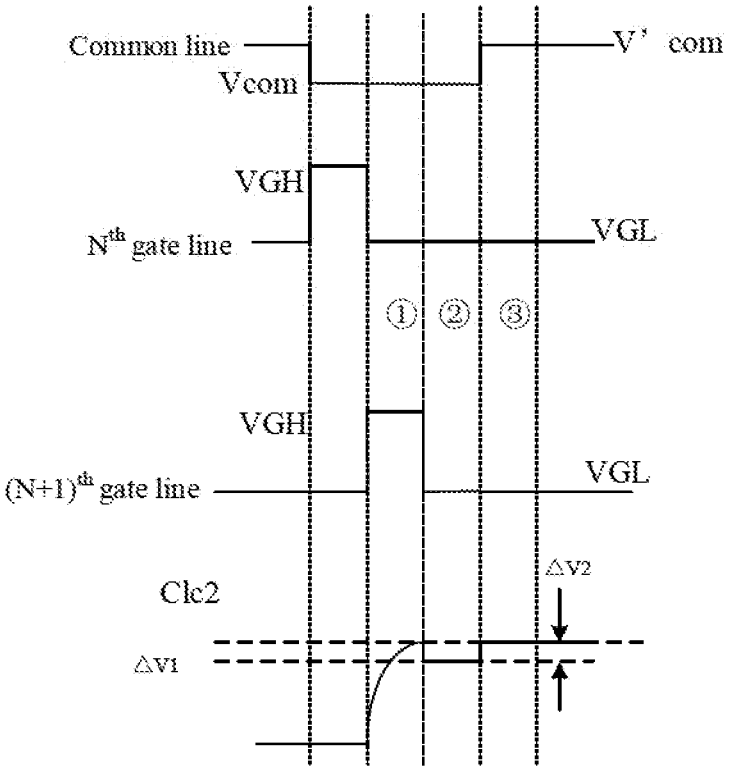
FIG. 5 is a schematic diagram of a driving waveform according to another embodiment of the present application.

As shown in FIG. 5.

At ①, Vpixel=Vdata

At ②, ΔV1=(VGH−VGL)*Cgs2/(Cgs+Cst+Clc).

At ③, ΔV2=(Vcom−V'com)*Cst2/(Cgs+Cst+Clc).

In order to reduce flicker issue caused by kickback, it is designed that ΔV1+ΔV2=0, and Cst2=(VGH−VGL)*Cgs2/V'com−Vcom).

As shown in FIGS. 6-8, the present application further discloses a display panel 110 using the driving method, including a plurality of data lines 130, a plurality of gate lines 140, a plurality of pixels 150, and a plurality of common lines 190; the data lines 130 are intersected with the gate lines 140; each pixel 150 is separately driven by corresponding data lines 130 and gate line 140; each pixel 150 corresponds to a pixel electrode; each common line 190 is disposed between upper and lower gate lines 140; the same common line 190 is connected to two adjacent pixels 150 to form a pixel group 160; the pixel 160 includes a first pixel 161 and a second pixel 162; the first pixel 161 and the second pixel 162 are connected to different data lines 130 and gate lines 140, where the common line 190 overlaps with the pixel electrode of the first pixel 161 corresponding to the previous gate line 140 to form a first overlap region 170, and the common line 190 overlaps with the pixel electrode of the second pixel 162 corresponding to the next gate line 140 to form a second overlap region 180.

In this solution, two pixels 150 corresponding to the upper and lower gate lines 140 of the same common line 190 are respectively formed with a storage capacitance; both sides of the shared common line 190 have an effect of shielding the electric field; the electric field is formed between the pixel 150 electrode and the common line 190, to reduce formation of the electric field between the pixel 150 electrode and the data line 130; crossing the gate above the shared common line 190 for forming the storage capacitance increases the pixel opening and the quantity of light of a liquid crystal display to obtain a display effect of power saving, cost saving or high brightness. Such pixel 150 design can achieve the driving method, reduce or even eliminate the flicker phenomenon of the display panel 110 caused by redistribution of the liquid crystal capacitance and the storage capacitance by the parasitic capacitance, and moreover, the opening rate can be increased, the penetration rate of the liquid crystal molecules is improved, and the large view-angle color offset is achieved.

In one or more embodiments, the common lines 190 include main common lines 200 and auxiliary common lines 210 conducted to each other; the main common lines 200 are intersected with the data lines 130, and the auxiliary common lines 210 and the data lines 130 are arranged in parallel; the main common lines 200 overlap with the pixel 150 electrode of the first pixel 161 and the pixel 150 electrode of the second pixel 162 to form a first main overlap region 220 and a second main overlap region 230, respectively; the auxiliary common lines 210 include first auxiliary common lines 240 and second auxiliary common lines 250, the pixel 150 electrode of the first pixel 161 and the first auxiliary common lines 240 form a first auxiliary overlap region 260, and the pixel 150 electrode of the second pixel 162 and the second auxiliary common lines 250 form a second auxiliary overlap region 270.

In this solution, the common lines 190 are divided into main common lines 200 and auxiliary common lines 210; the main common lines 200 are intersected with the data lines 130, the increased auxiliary common lines 210 and the data lines 130 are arranged in parallel, and the main common lines 200 and the auxiliary common lines 210 are conducted to each other to reduce the influence of the pixel 150 electrode to the voltage of the data line 130 to cause so-called crosstalk to affect the picture quality, and to reduce the influence of the parasitic capacitance generated by the gate line 140 and the pixel 150 electrode on the display flicker of the display panel 110.

In one or more embodiments, the first auxiliary common line 240 and the second auxiliary common line 250 are a straight line. In this solution, it is more convenient and timesaving in the manufacturing process that the first auxiliary common line 240 and the second auxiliary common line 250 are a straight line.

In one or more embodiments, there are two first auxiliary common lines 240, respectively disposed at both sides of the first pixel 161 close to the data lines 130; and the two first auxiliary common lines 240 overlap with the pixel 150 electrode of the first pixel 161 to form two overlap regions; there are two second auxiliary common lines 250, respectively disposed at both sides of the second pixel 162 close to the data lines 130; and the two second auxiliary common lines 250 overlap with the pixel 150 electrode of the second pixel 162 to form two overlap regions; and the two second auxiliary common lines 250 and the two first auxiliary common lines 240 form two straight lines.

In this solution, both sides of the shared common line 190 have an effect of shielding the electric field; the electric field is formed between the pixel 150 electrode and the common line 190, to reduce formation of the electric field between the pixel 150 electrode and the data line 130; the pixel 150 electrode is across above the shared common line 190 for forming the storage capacitance; the gate electrode and the pixel 150 electrode are easy to generate the parasitic capacitance Cgs, and the kickback voltage generated by the parasitic capacitance Cgs would redistribute the storage capacitance and the liquid crystal capacitance. The present application uses the space at both sides of the pixel 150 electrode to form the storage capacitance Cst; two pixels 150 in the pixel group 160 respectively correspond to different data lines 130, ensuring the size of the data driving voltage of each pixel 150 and preventing decrease of the data voltage due to the load of the pixel 150 electrode per se; the electric field is formed between the pixel 150 electrode and the gate line 140; the auxiliary common lines 210 are provided at both sides of the first pixel 161 and the second pixel 162, and form overlap regions with the pixel 150 electrodes of the first pixel 161 and the second pixel 162; increasing the storage capacitance can also increase the pixel opening and the quantity of light of the liquid crystal display, so that the display effect of energy saving, cost saving or high brightness can be obtained, thereby reducing the influence of the parasitic capacitance generated by the pixel 150 electrode and the gate line 140, and reducing or even eliminating the flicker of the display panel 110 caused by the redistribution of the parasitic capacitance to the liquid crystal capacitance and the storage capacitance.

In one or more embodiments, a first safety distance is arranged between the first auxiliary common line 240 and the pixel 150 electrode of the first pixel 161; and a second safety distance is arranged between the auxiliary common line 210 and the corresponding data line 130. In this solution, an electric field would be generated between the pixel 150 electrode and the auxiliary common line 210; if the distance is too close, the generated electric field is stronger, to affect the transmission of a data voltage signal, causing unstable voltage to affect the display of picture; and setting a safety distance can prevent the influence of the electric field, reduce the crosstalk phenomenon, and prevent the picture quality of the display panel 110 from being affected.

Figure 9:
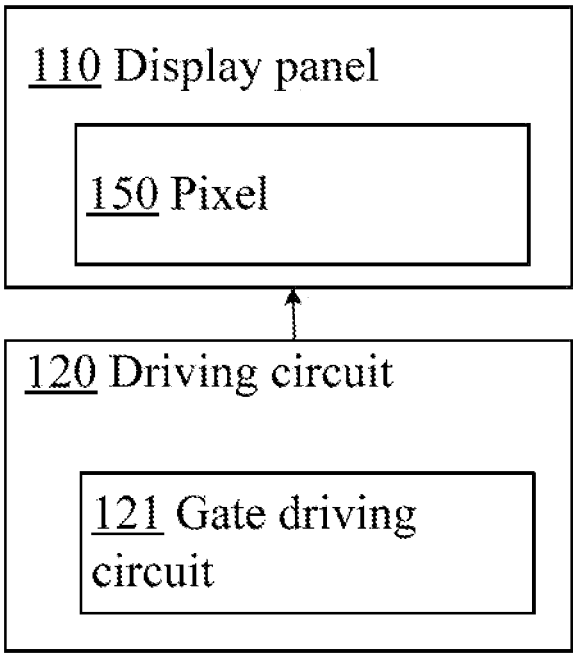
FIG. 9 is a schematic diagram of a driving circuit according to another embodiment of the present application.

As shown in FIG. 9, a driving circuit 120 drives the display panel 110; the driving circuit 120 includes a gate driving circuit 121 configured to output a gate driving signal to a corresponding gate line 140 of the display panel 110; where a signal period of a common level signal of the common line 190 includes a first time and a second time, the first time corresponds to a first common level, the second time corresponds to a second common level, and a voltage value of the first common level in the first time is less than a voltage value of the second common level in the second time; for the common line 190 corresponding to the $N^{th}$ gate line 140, a start moment of the first time is no later than an open moment of the corresponding $N^{th}$ gate line 140, and a start moment of the second time is later than a close moment of the $(N+1)^{th}$ gate line.

In this solution, the driving circuit 120 is configured to drive the display panel 110; the gate driving circuit 121 in the driving circuit 120 outputs a signal to a corresponding gate line 140 of the display panel 110; a corresponding signal is output to open corresponding gate line 140; the period of the gate driving signal is divided into three time periods for respectively outputting different levels; the voltage pull-down time is set for different time periods due to the kickback voltage caused by the parasitic capacitance generated by the pixel 150 electrode and the gate line 140, to form a correct loop, solving the flicker phenomenon caused by the kickback voltage.

Figure 10:
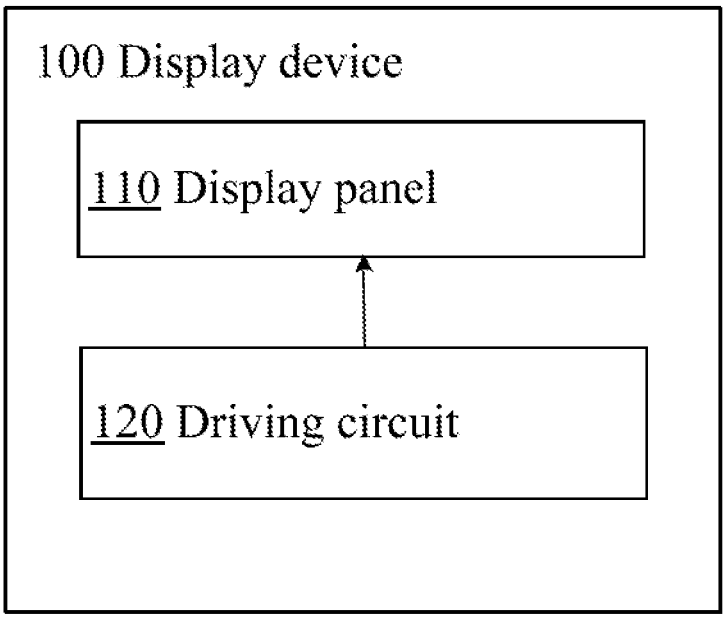
FIG. 10 is a schematic diagram of a display device according to another embodiment of the present application.

As shown in FIG. 10, as another embodiment of the present application, disclosed is a display device 100, including the display panel 110.

It should be noted that the definitions of steps involved in this solution are not intended to limit the sequence of steps without affecting the implementation of the specific solution. The preceding steps can be executed anteriorly, and can also be executed posteriorly, or even can be executed simultaneously. As long as this solution can be implemented, it should be considered as the scope of protection of the present application.

The technical solution of the present application can be widely applied to various display panels, such as a Twisted Nematic (TN) display panel, an In-Plane Switching (IPS) display panel, a Vertical Alignment (VA) display panel, and a Multi-domain Vertical Alignment (MVA) display panel, and certainly, may also be other types of display panels, such as an OLED display panel, if appropriate.

The contents above are detailed descriptions of the present application in conjunction with optional specific embodiments, and the specific implementation of the present application is not limited to these descriptions. It will be apparent to those skilled in the art that various simple deductions or substitutions may be made without departing from the spirit of the present application, and should be considered to be within the scope of protection of the present application.

What is claimed is:

1. A driving method, applied to a display panel, the display panel comprising:

a plurality of data lines;

a plurality of gate lines intersected with the data lines;

a plurality of pixels respectively driven by corresponding data lines and gate lines, each pixel comprising a corresponding pixel electrode; and a plurality of common lines respectively disposed between upper and lower gate lines, the common lines overlapping with a pixel electrode of a pixel corresponding to the previous gate line and overlapping with a pixel electrode of a pixel corresponding to the next gate line;

the driving method comprises a step of outputting a gate driving signal to a corresponding gate line of the display panel;

wherein a signal period of a common level signal of the common line comprises a first time and a second time, the first time corresponds to a first common level, the second time corresponds to a second common level, and a voltage value of the first common level in the first time is less than a voltage value of the second common level in the second time;

for the common line corresponding to the $N^{th}$ gate line, a start moment of the first time is no later than an open moment of the corresponding $N^{th}$ gate line, and a start moment of the second time is no earlier than a close moment of the $(N+1)^{th}$ gate line;

N is a natural number at least equal to 1;

wherein each pixel comprises a pixel electrode, a same common line is connected to two adjacent pixels to form a pixel group, the pixel group comprises a first pixel and a second pixel, and the first pixel and the second pixel are connected to different data lines and gate lines;

wherein a pixel electrode of the first pixel of the pixel group overlaps with the common line to form a first overlap region; a first storage capacitance formed by the first overlap region of the first pixel and the common line is Cst1, a pixel capacitance of the first pixel is Clc1, a parasitic capacitance formed by the pixel electrode of the first pixel and the $N^{th}$ gate line is Cgs1, the first common level corresponding to the first time is Vcom, and the second common level corresponding to the second time is V'com;

a voltage value of a high level of the gate open time is VGH, and a voltage value of a low level of the gate close time is VGL;

$$Cst1=(VGH-VGL)*Cgs1/(V'com-Vcom).$$

2. The driving method according to claim 1, wherein at a same moment, the common line corresponding to the $N^{th}$ gate line is open, and the $N^{th}$ gate line is also open.

3. The driving method according to claim 1, wherein the start moment of the second time and the close moment of the $(N+1)^{th}$ gate line are the same moment.

4. The driving method according to claim 1, wherein a period of the first time is triple a period of the open time of a gate line.

5. The driving method according to claim 1, wherein a pixel electrode of the second pixel of the pixel group overlaps with a same common line corresponding to the first pixel to form a second overlap region, a second storage capacitance formed by the second overlap region of the second pixel and the common line is Cst2, a pixel capacitance of the second pixel is Clc2, and a parasitic capacitance formed by the pixel electrode of the second pixel and the $(N+1)^{th}$ gate line is Cgs2;

$$Cst2=(VGH-VGL)*Cgs2/(V'com-Vcom).$$

6. A display panel using the driving method according to claim 1, comprising:

a plurality of data lines;

a plurality of gate lines intersected with the data lines;

a plurality of pixels respectively driven by corresponding data lines and gate lines, each pixel comprising a corresponding pixel electrode; and a plurality of common lines respectively disposed between upper and lower gate lines;

wherein a same common line is connected to two adjacent pixels to form a pixel group, the pixel group comprises a first pixel and a second pixel, and the first pixel and the second pixel are connected to different data lines and gate lines;

wherein the common line overlaps with a pixel electrode of the first pixel corresponding to the previous gate line to form a first overlap region, and the common line overlaps with a pixel electrode of the second pixel corresponding to the next gate line to form a second overlap region.

7. The display panel according to claim 6, wherein the common lines comprise main common lines and auxiliary common lines conducted to each other;

the main common lines are intersected with the data lines, and the auxiliary common lines and the data lines are arranged in parallel;

the main common lines overlap with the pixel electrode of the first pixel and the pixel electrode of the second pixel to form a first main overlap region and a second main overlap region, respectively;

the auxiliary common lines comprise first auxiliary common lines and second auxiliary common lines, the pixel electrode of the first pixel and the first auxiliary common lines form a first auxiliary overlap region, and the pixel electrode of the second pixel and the second auxiliary common lines form a second auxiliary overlap region.

8. The display panel according to claim 7, wherein there are two first auxiliary common lines, respectively disposed at both sides of the first pixel close to the data lines; and the two first auxiliary common lines overlap with the pixel electrode of the first pixel to form two overlap regions;

there are two second auxiliary common lines, respectively disposed at both sides of the second pixel close to the data lines; and the two second auxiliary common lines overlap with the pixel electrode of the second pixel to form two overlap regions.

9. The display panel according to claim 8, wherein the first auxiliary common line and the second auxiliary common line are a straight line.

10. The display panel according to claim 8, wherein the two second auxiliary common lines and the two first auxiliary common lines form two straight lines.

11. The display panel according to claim 7, wherein a first safety distance is arranged between the first auxiliary common line and the pixel electrode of the first pixel.

12. The display panel according to claim 7, wherein a second safety distance is arranged between the auxiliary common line and the corresponding data line.

13. A driving circuit configured to driving a display panel, the display panel comprises:

a plurality of data lines;

a plurality of gate lines intersected with the data lines;

a plurality of pixels respectively driven by corresponding data lines and gate lines, each pixel corresponding to a pixel electrode; and a plurality of common lines respectively disposed between upper and lower gate lines;

wherein a same common line is connected to two adjacent pixels to form a pixel group, the pixel group comprises a first pixel and a second pixel, and the first pixel and the second pixel are connected to different data lines and gate lines;

wherein the common line overlaps with a pixel electrode of a first pixel corresponding to the previous gate line to form a first overlap region, and the common line overlaps with a pixel electrode of a second pixel corresponding to the next gate line to form a second overlap region;

the driving circuit comprises:

a gate driving circuit configured to output a gate driving signal to a corresponding gate line of the display panel;

wherein a signal period of a common level signal of the common line comprises a first time and a second time, the first time corresponds to a first common level, the second time corresponds to a second common level, and a voltage value of the first common level in the first time is less than a voltage value of the second common level in the second time;

for the common line corresponding to the $N^{th}$ gate line, a start moment of the first time is no later than an open moment of the corresponding $N^{th}$ gate line, and a start moment of the second time is later than a close moment of the $(N+1)^{th}$ gate line;

N is a natural number at least equal to 1;

wherein each pixel comprises a pixel electrode, a same common line is connected to two adjacent pixels to form a pixel group, the pixel group comprises a first pixel and a second pixel, and the first pixel and the second pixel are connected to different data lines and gate lines;

wherein a pixel electrode of the first pixel of the pixel group overlaps with the common line to form a first overlap region; a first storage capacitance formed by the first overlap region of the first pixel and the common line is Cst1, a pixel capacitance of the first pixel is Clc1, and a parasitic capacitance formed by the pixel electrode of the first pixel and the $N^{th}$ gate line is Cgs1;

the first common level corresponding to the first time is Vcom, and the second common level corresponding to the second time is V'com;

a voltage value of a high level of the gate open time is VGH, and a voltage value of a low level of the gate close time is VGL;

$$Cst1=(VGH-VGL)*Cgs1/(V'com-Vcom).$$

14. The driving circuit according to claim 13, wherein the common line corresponding to the $N^{th}$ gate line is open at the first time, and the $N^{th}$ gate line is also open.

15. The driving circuit according to claim 13, wherein the start moment of the second time and the close moment of the $(N+1)^{th}$ gate line are the same moment.

16. The driving circuit according to claim 13, wherein a period of the first time is triple a period of the open time of a gate line.

17. The driving circuit according to claim 13, wherein a pixel electrode of the second pixel of the pixel group overlaps with a same common line corresponding to the first pixel to form a second overlap region, a second storage capacitance formed by the second overlap region of the second pixel and the common line is Cst2, a pixel capacitance of the second pixel is Clc2, and a parasitic capacitance formed by the pixel electrode of the second pixel and the $(N+1)^{th}$ gate line is Cgs2;

$$Cst2=(VGH-VGL)*Cgs2/(V'com-Vcom).$$

* * * * *